US008040304B2

(12) United States Patent
Huang et al.

(10) Patent No.: US 8,040,304 B2
(45) Date of Patent: Oct. 18, 2011

(54) ACTIVE MATRIX ORGANIC LIGHT EMITTING DIODE PANEL

(75) Inventors: Jiunn-Yau Huang, Tainan County (TW); Cheng-Chi Yen, Tainan County (TW)

(73) Assignee: N Spine, Inc., San Diego, CA (US)

( * ) Notice: Subject to any disclaimer, the term of this patent is extended or adjusted under 35 U.S.C. 154(b) by 750 days.

(21) Appl. No.: 11/798,014

(22) Filed: May 9, 2007

(65) Prior Publication Data

US 2007/0262930 A1 Nov. 15, 2007

(30) Foreign Application Priority Data

May 9, 2006 (TW) ..... 95116424 A

(51) Int. Cl.
*G09G 3/32* (2006.01)

(52) U.S. Cl. ..... 345/82

(58) Field of Classification Search ..... 345/76, 345/82, 84, 39; 315/169.3, 169.1
See application file for complete search history.

(56) References Cited

U.S. PATENT DOCUMENTS 6,433,488 B1 * 8/2002 Bu ..... 315/169.3
6,747,417 B2 6/2004 Meade et al.
7,292,219 B2 11/2007 Sun
7,580,012 B2 * 8/2009 Kim et al. ..... 345/76
2002/0075208 A1 * 6/2002 Bae et al. ..... 345/76
2003/0223275 A1 * 12/2003 Abe ..... 365/189.09

FOREIGN PATENT DOCUMENTS

TW 200306519 11/2003
TW I239496 B 9/2005
WO WO2004/097781 * 11/2004

* cited by examiner

*Primary Examiner* — Quan-Zhen Wang
*Assistant Examiner* — Calvin Ma
(74) *Attorney, Agent, or Firm* — Rabin & Berdo, P.C.

(57) ABSTRACT

An AMOLED panel includes an AMOLED pixel unit, a scan driving unit and a data driving unit. The scan driving unit is coupled to the AMOLED pixel unit. The data driving unit is coupled to the AMOLED pixel unit and a voltage source. The data driving unit comprises a reference current source circuit, (N+1) mirror output circuits and (N+1) switch elements. The reference current source circuit is for providing a reference current. (N+1) mirror output circuits are coupled to the reference current source circuits for outputting (N+1) corresponding data currents to the AMOLED pixel unit, wherein N is a positive integer. The m-th data current of the (N+1) data currents is $2^m$ times of the reference current, and m is an integer 0~N. The switch elements are disposed in correspondence with the mirror output circuits for controlling the data currents to be outputted to the AMOLED pixel unit.

7 Claims, 4 Drawing Sheets

ACTIVE MATRIX ORGANIC LIGHT EMITTING DIODE PANEL

This application claims the benefit of Taiwan application Serial No. 95116424, filed May 9, 2006, the subject matter of which is incorporated herein by reference.

BACKGROUND OF THE INVENTION

1. Field of the Invention

The invention relates in general to an active matrix organic light emitting diode (AMOLED) panel, and more particularly to an AMOLED panel driven by a large current.

2. Description of the Related Art

Normally, in an AMOLED display, images are displayed by a large number of pixels on the AMOLED panel. Each pixel of the AMOLED panel is controlled according to a data signal so as to display the required luminance.

Referring to FIG. 1, a circuit diagram of a conventional AMOLED panel is shown. In an AMOLED panel 10, during a writing time period, a scan signal Scan outputted by a scan driving unit 14 turns on transistors T1 and T2 in the AMOLED pixel unit 11. Due to a current IData of the data driving unit 12, the same current IData is generated on the transistor T3. Owing that the transistors T3 and T4 form a current mirror structure, the transistor T4 generates a current IOLED proportional to the current IData. The transistor T4 outputs the current IOLED to a light emitting diode 16 to display the corresponding luminance. At the same time, the capacitor C is also charged to a corresponding voltage level.

Afterward, in a display time period, the scan signal Scan turns off the transistor T1 and T2 to electrically isolate the transistor T4 from the data driving unit 12. The voltage difference between the source and gate of the transistor T4 can be stabilized at the corresponding voltage level by the capacitor C. Therefore, the current IOLED can be maintained at a certain value stably. However, the above data driving unit 12 can provide only a limited current IData. If a larger current is to be required, the area of the data driving unit 12 has to be increased, thereby improving production cost.

SUMMARY OF THE INVENTION

The invention is directed to an AMOLED panel. By using a number of mirror output circuits, a larger current can be provided to drive the pixels of the AMOLED panel.

According to the present invention, an AMOLED panel is provided. The AMOLED panel comprises an AMOLED pixel unit, a scan driving unit and a data driving unit. The scan driving unit is coupled to the AMOLED pixel unit. The data driving unit is coupled to the AMOLED pixel unit and a voltage source. The data driving unit comprises a reference current source circuit, (N+1) mirror output circuits and (N+1) switch elements. The reference current source circuit is for providing a reference current. (N+1) mirror output circuits are coupled to the reference current source circuit for outputting (N+1) corresponding data currents to the AMOLED pixel unit, wherein N is a positive integer. The m-th data current of the (N+1) data currents is $2^m$ times of the reference current, and m is an integer 0~N. The switch elements are disposed in correspondence with the mirror output circuits for controlling the data currents to be outputted to the AMOLED pixel unit.

The invention will become apparent from the following detailed description of the preferred but non-limiting embodiments. The following description is made with reference to the accompanying drawings.

DETAILED DESCRIPTION OF THE INVENTION

Figure 1:
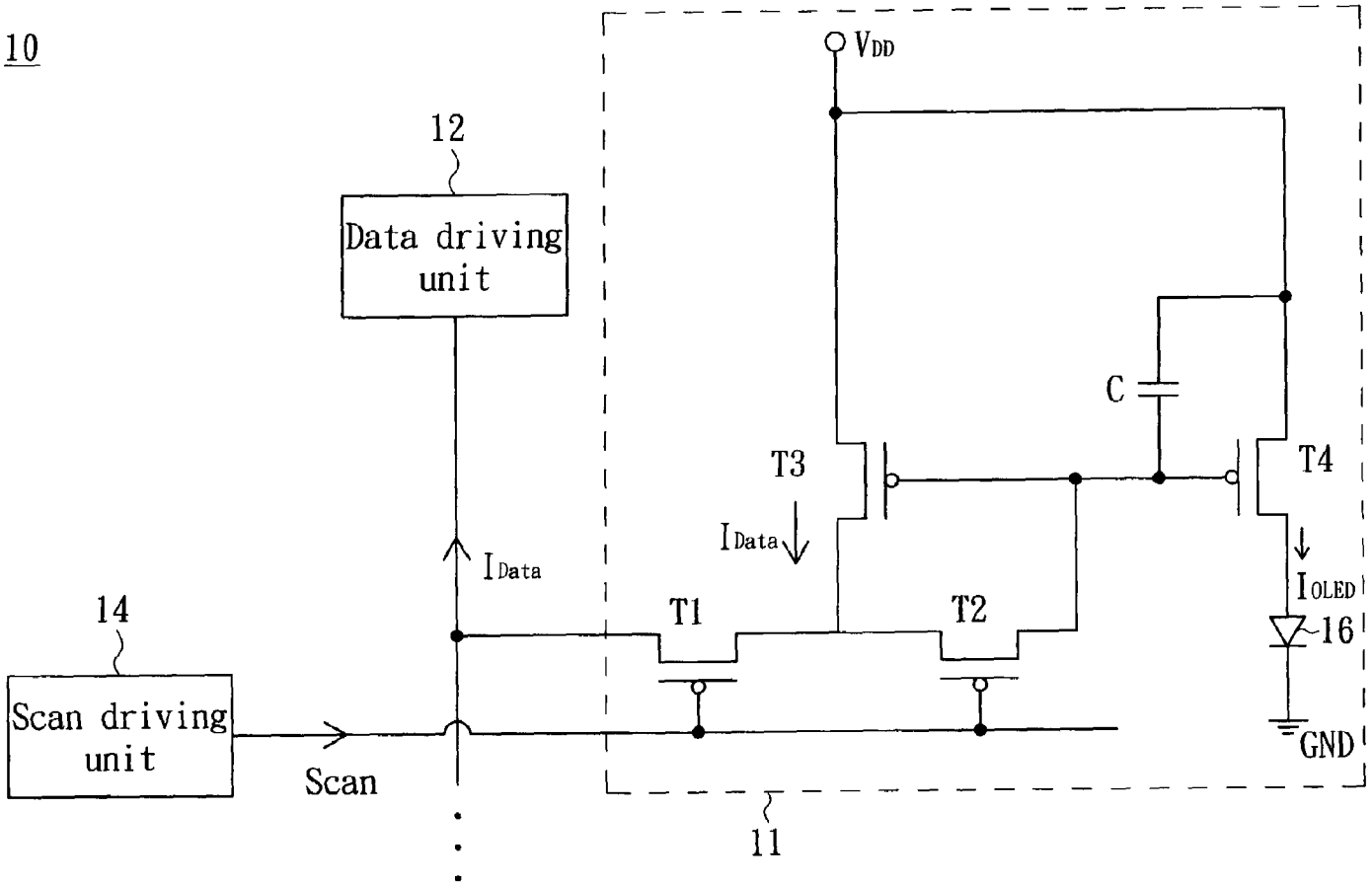
FIG. 1(PRIOR ART)
FIG. 1 is a circuit diagram of a conventional AMOLED panel.
Figure 2:
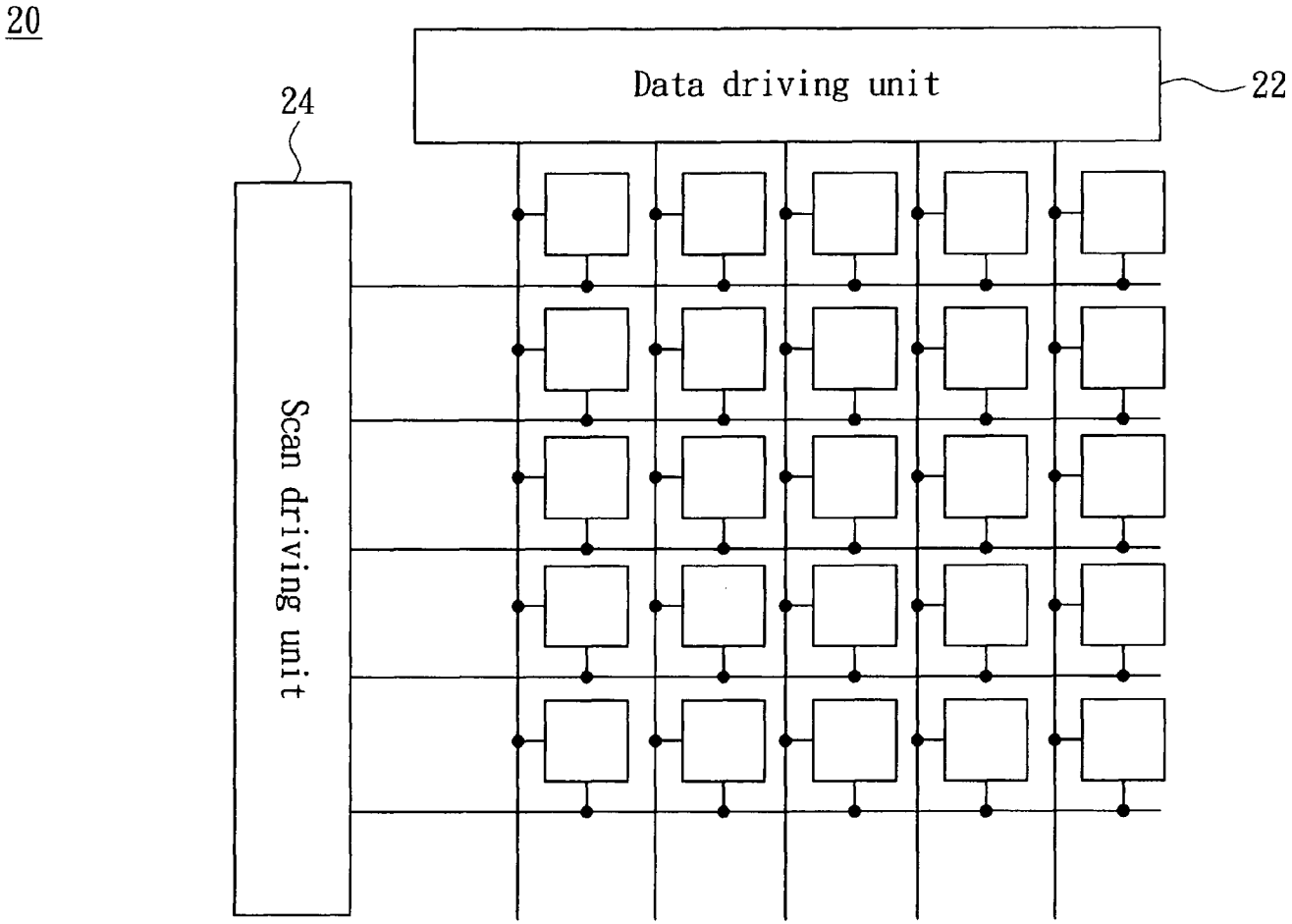
FIG. 2 is a function block diagram of an AMOLED pixel driving circuit according to a preferred embodiment of the invention.
Figure 3:
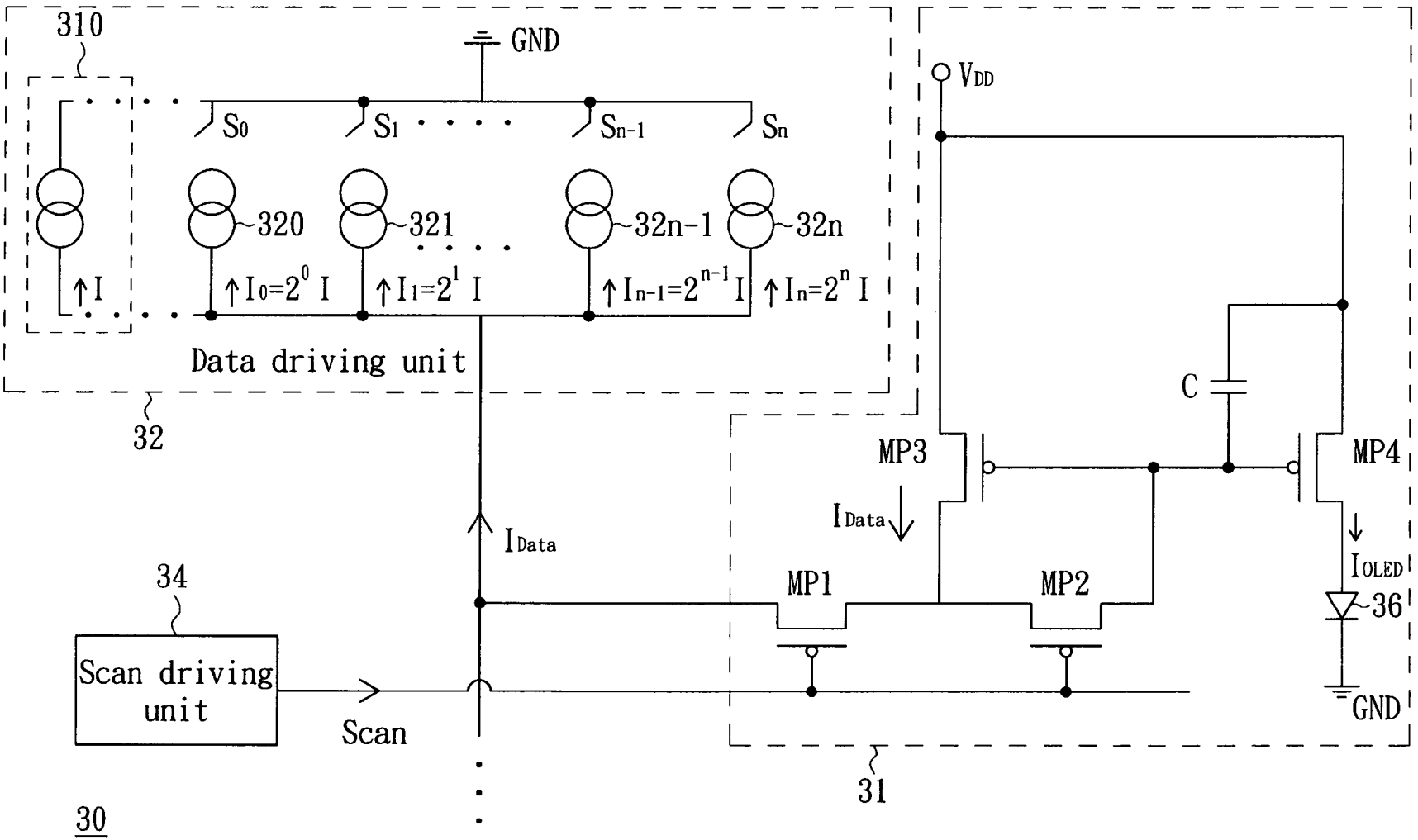
FIG. 3 is a schematic diagram of an AMOLED panel according to the preferred embodiment of the invention.

The invention uses (N+1) mirror output circuits to provide a larger current for driving pixels. Referring to FIG. 2, a function block diagram of an AMOLED pixel driving circuit according to a preferred embodiment of the invention is shown. In the AMOLED pixel driving circuit 20, a data driving unit 22 and a scan driving unit 24 are respectively used to control AMOLEDs in a certain column and row of pixels Referring to FIG. 3, a schematic diagram of an AMOLED panel according to the preferred embodiment of the invention is shown. An AMOLED panel 30 includes an AMOLED pixel unit 31, a data driving unit 32 and a scan driving unit 34. The AMOLED pixel unit 31 includes an AMOLED 36, a first switch element MP1, a second switch element MP2, a third switch element MP3, a fourth switch element MP4 and an energy storage element C. For example, the switch elements MP1~MP4 are implemented by p-type metal oxide semiconductor (PMOS) transistors and the energy storage element is a capacitor.

The AMOLED 36 is coupled to a voltage source, such as a ground voltage GND. The transistor MP1 has a first terminal coupled to the data driving unit 32 and a control terminal coupled to the scan driving unit 34. The transistor MP2 has a first terminal coupled to a second terminal of the transistor MP1 and a control terminal coupled to the scan driving unit 34. The transistor MP3 has a first terminal coupled to the first terminal of the transistor MP2, a second terminal coupled to a first voltage, such as an operational voltage VDD, and a control terminal coupled to a second terminal of the transistor MP2. The transistor MP4 has a first terminal coupled to the AMOLED 36, a second terminal coupled to the operational voltage VDD and a control terminal coupled to the control terminal of the transistor MP3. The capacitor C has a first terminal coupled to the control terminal of the transistor MP4 and a second terminal coupled to the second terminal of the transistor MP4.

During a writing time period, a scan signal Scan outputted by the scan driving unit 34 turns on the transistors MP1 and MP2. Due to a current IData of the data driving unit 32, the transistor MP3 also generates the same current IData. Owing that the transistors MP3 and MP4 form a circuit of current mirror, the transistor MP4 generates a current IOLED proportional to the current IData and outputs the current IOLED to the AMOLED 36 to display the corresponding luminance. At the same time, the capacitor C is also charged to the corresponding voltage level.

Afterward, during a display time period, the scan signal Scan turns off the transistors MP1 and MP2, and thus the transistor MP4 is electrically isolated from the data driving unit 12. The voltage difference between the source and gate of the transistor MP4 stably maintains at the corresponding voltage level by the capacitor C, and thus the current IOLED stably maintains at a specific value.

In the above AMOLED panel 30, the data driving unit 32 includes a reference current source circuit 310, (N+1) mirror output circuits 320~32*n* and (N+1) switch elements S0~Sn, wherein N is a positive integer. The reference current source circuit 310 is for providing a reference current I. The mirror output circuits 320~32*n* are coupled to the reference current source circuit 310. The AMOLED pixel unit 31 can draft data currents I0~In from the data driving unit 32. The data currents I0~In have a proportion relationship corresponding to the reference current I, such as the data current Im (m=0~n) is $2^m \times I$, wherein I is a constant current.

The switch elements S0~Sn are disposed in correspondence with the mirror output circuits 320~32*n* for controlling the AMOLED pixel unit 31 to draft the data currents I0~In. The position of switch elements S0~Sn can be changed. For example, each of the switch elements S0~Sn has a first terminal coupled to a ground voltage GND and a second terminal coupled to the corresponding mirror output circuit 320~32*n*. The switch elements S0~Sn can also be disposed at different positions. For example, each of the switch elements S0~Sn has a first terminal coupled to the corresponding mirror output circuit 320~32*n* and a second terminal coupled to the AMOLED pixel unit 31.

Whether the AMOLED pixel unit 31 can draft the data currents I0~In to generate the data current IData depends on openness or closeness of the switch elements S0~Sn. That is, the amount of the data current IData is controlled by the switch elements S0~Sn. For example, when only the switch element S0 is turned on, the data current IData is smallest, which is equal to I. When the switch elements S0~Sn are all turned on, the data current IData is largest, which is equal to $(1+2+4+\ldots+2^n)I=(2^{n+1}-1)I$. As mentioned above, the AMOLED pixel unit 31 can obtain $(2^{n+1}-1)$ different kinds of data currents IData. Therefore, the AMOLED panel 30 can drive the AMOLED 36 by a large current.

Figure 4:
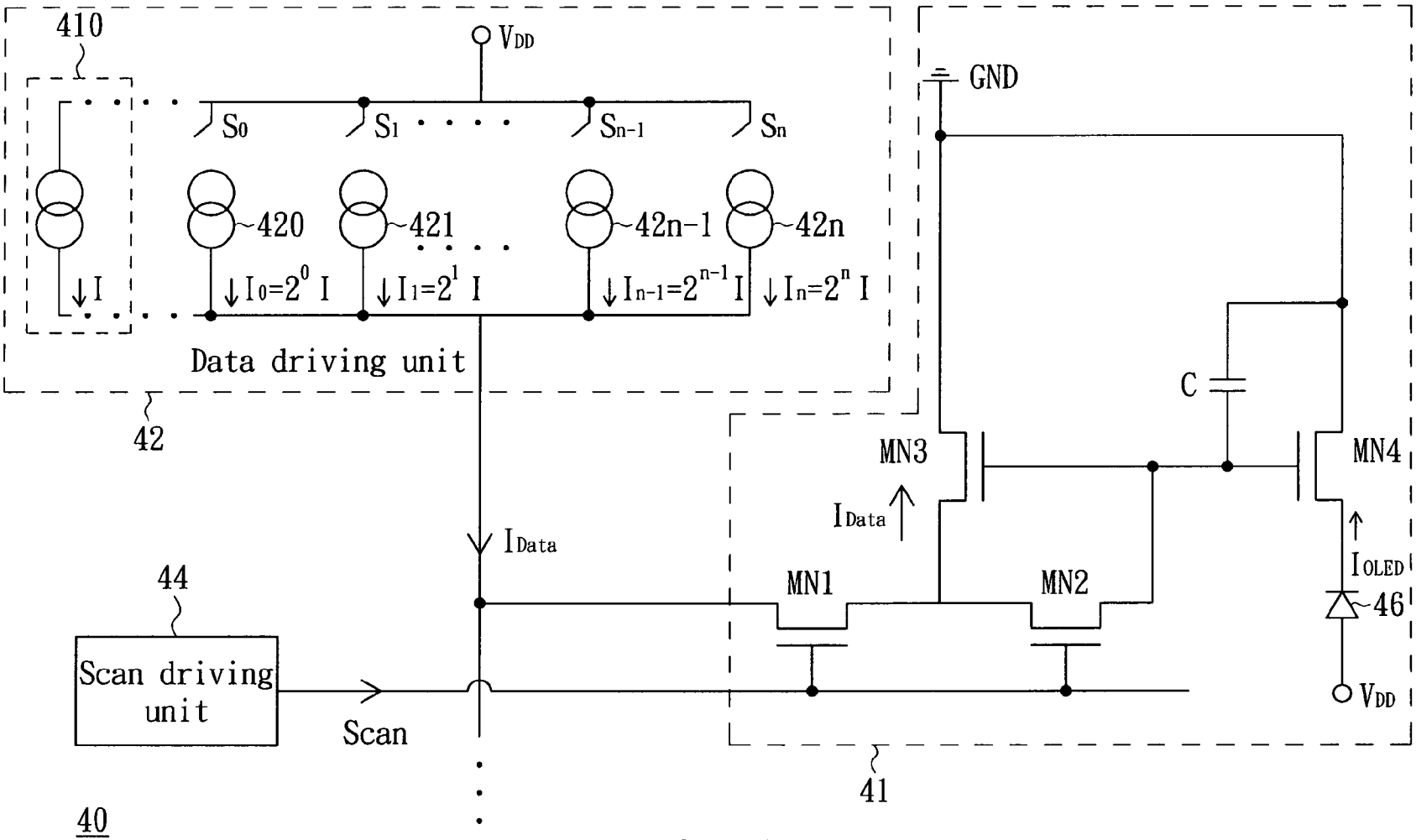
FIG. 4 is a circuit diagram of another AMOLED panel according to the preferred embodiment of the invention.

In the above AMOLED panel 30, the first switch element to the fourth switch element can also be implemented by n-type metal oxide semiconductor (NMOS) transistors. Referring to FIG. 4, a circuit diagram of another AMOLED panel 40 according to the preferred embodiment of the invention is shown. The transistor MN1 has a first terminal coupled to the data driving unit 32, and a control terminal coupled to the scan driving unit 44. The transistor MN2 has a first terminal coupled to a second terminal of the transistor MN1 and a control terminal coupled to the scan driving unit 44. The transistor MN3 has a first terminal coupled to the first terminal of the transistor MN2, a second terminal coupled to the ground voltage GND and a control terminal coupled to a second terminal of the transistor MN2. The transistor MN4 has a first terminal coupled to the AMOLED 46, a second terminal coupled to a voltage source, such as a ground voltage GND and a control terminal coupled to the control terminal of the transistor MN3. The capacitor C has a first terminal coupled to the control terminal of the transistor MN4 and a second terminal coupled to the second terminal of the transistor MN4. Besides, the data driving unit 42 is coupled to the operational voltage VDD.

The above AMOLED panel 40 operates in the same rule as the AMOLED panel 30.

The AMOLED panel disclosed by the above embodiment of the invention uses a number of mirror output circuits to provide a larger current for driving the AMOLED pixels and provide different currents for driving the AMOLED pixels.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An active matrix organic light emitting diode (AMOLED) panel, comprising:

an AMOLED pixel unit;

a scan driving unit, coupled to the AMOLED pixel unit; and a data driving unit, coupled to the AMOLED pixel unit and a voltage source, the data driving unit comprising:

a reference current source circuit, for providing a reference current I;

(N+1) mirror output circuits, coupled to the reference current source circuit for outputting (N+1) corresponding data currents to the AMOLED pixel unit, wherein N is a positive integer, the m-th data current of the (N+1) data currents is $2^m$ times the reference current I for each integer m of the integers 0~N; and (N+1) switch elements, disposed in correspondence with the (N+1) mirror output circuits for respectively controlling the (N+1) data currents to be outputted to the AMOLED pixel unit, wherein the data current outputted to the AMOLED pixel unit has a smallest current equal to the reference current I., whereby in an on condition, the (N+1) switch elements transmit to the AMOLED pixel unit a total current equal a sum of the (N+1) data currents, $(1+2+\ldots+2^m)I$, which is equal to $(2^{N+1}-1)I$.

2. The AMOLED panel according to claim 1, wherein each of the (N+1) switch elements has a first terminal coupled to the voltage source and a second terminal coupled to the corresponding mirror output circuit.

3. The AMOLED panel according to claim 1, wherein each of the (N+1) switch elements has a first terminal coupled to the corresponding mirror output circuit and a second terminal coupled to the AMOLED pixel unit.

4. The AMOLED panel according to claim 1, wherein the AMOLED pixel unit comprises:

an AMOLED, coupled to the voltage source;

a first switch element, having a first terminal coupled to the data driving unit and a control terminal coupled to the scan driving unit;

a second switch element, having a first terminal coupled to a second terminal of the first switch element and a control terminal coupled to the scan driving unit;

a third switch element, having a first terminal coupled to the first terminal of the second switch element, a second terminal coupled to a first voltage, and a control terminal coupled to a second terminal of the second switch element;

a fourth switch element, having a first terminal coupled to the AMOLED, a second terminal coupled to the first voltage and a control terminal coupled to the control terminal of the third switch element; and an energy storage element, having a first terminal coupled to the control terminal of the fourth switch element and a second terminal coupled to the second terminal of the fourth switch element.

5. The AMOLED panel according to claim 4, wherein the energy storage element is a capacitor.

6. The AMOLED panel according to claim 4, wherein the first switch element, the second switch element, the third switch element and the fourth switch element are implemented by P-type metal oxide semiconductor (PMOS) transistors, the voltage source outputs a ground voltage, and the first voltage is an operational voltage.

7. The AMOLED panel according to claim 4, wherein the first switch element, the second switch element, the third switch element and the fourth switch element are implemented by N-type metal oxide semiconductor (NMOS) transistors, the voltage source outputs an operational voltage, and the first voltage is a ground voltage.

* * * * *

UNITED STATES PATENT AND TRADEMARK OFFICE

CERTIFICATE OF CORRECTION

PATENT NO. : 8,040,304 B2
APPLICATION NO. : 11/798014
DATED : October 18, 2011
INVENTOR(S) : Jiunn-Yau Huang et al.

It is certified that error appears in the above-identified patent and that said Letters Patent is hereby corrected as shown below:

Title Page, Item (73) (Assignee)

Please replace the Assignee name with the following:

--HIMAX TECHNOLOGIES LIMITED, Tainan County (TW)
HIMAX DISPLAY, INC., Tainan County (TW)--

Signed and Sealed this
Twenty-eighth Day of May, 2013

Teresa Stanek Rea
*Acting Director of the United States Patent and Trademark Office*